US008356655B2

(12) United States Patent
Bochiechio et al.

(10) Patent No.: US 8,356,655 B2
(45) Date of Patent: Jan. 22, 2013

(54) SHOT TUBE PLUNGER FOR A DIE CASTING SYSTEM

(75) Inventors: Mario P. Bochiechio, Vernon, CT (US); Mark F. Bartholomew, Enfield, CT (US); Carl R. Verner, Windsor, CT (US); John F. Blondin, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/023,607

(22) Filed: Feb. 9, 2011

(65) Prior Publication Data

US 2012/0199305 A1 Aug. 9, 2012

(51) Int. Cl.
*B22D 17/00* (2006.01)
*B22D 27/04* (2006.01)

(52) U.S. Cl. ..... 164/312; 164/348

(58) Field of Classification Search ..... 164/4.1, 164/457, 151.4, 303–313, 348, 113
See application file for complete search history.

(56) References Cited

U.S. PATENT DOCUMENTS

| | | | | |
|---|---|---|---|---|
| 4,036,113 | A | 7/1977 | Kunz | |
| 4,334,575 | A | 6/1982 | Miki et al. | |
| 4,583,579 | A * | 4/1986 | Miki et al. | 164/457 |
| 4,667,729 | A | 5/1987 | Zecman | |
| 4,779,665 | A | 10/1988 | Ouimet | |
| 4,871,010 | A | 10/1989 | Dannoura | |
| 5,076,343 | A | 12/1991 | Sandercock | |
| 5,860,468 | A * | 1/1999 | Cook | 164/61 |
| 5,947,183 | A | 9/1999 | Schneider et al. | |
| 6,378,597 | B1 | 4/2002 | Zecman | |
| 7,128,128 | B2 | 10/2006 | Kaba et al. | |
| 2006/0254747 | A1 | 11/2006 | Ishida et al. | |
| 2007/0137830 | A1 * | 6/2007 | Unal | 164/480 |
| 2009/0139683 | A1 | 6/2009 | Muller et al. | |

FOREIGN PATENT DOCUMENTS

| | | | |
|---|---|---|---|
| DE | 3323328 | C1 * | 5/1984 |
| EP | 0691166 | A1 | 1/1996 |
| JP | 61148456 | | 9/1986 |
| JP | 10058108 | | 3/1998 |
| WO | 0051764 | | 9/2000 |

OTHER PUBLICATIONS

Partial European Search Report for Application No. EP 12 15 4110 dated Jun. 21, 2012.
Extended European Search Report for Application No. EP 12 15 4110 dated Sep. 28, 2012.

* cited by examiner

*Primary Examiner* — Kevin P Kerns
*Assistant Examiner* — Steven Ha
(74) *Attorney, Agent, or Firm* — Carlson, Gaskey & Olds PC

(57) ABSTRACT

A shot tube plunger of a die casting system includes a tip portion and a thermal control scheme at least partially disposed within the shot tube plunger. The thermal control scheme includes a fluid passageway having at least one coiled portion that receives a fluid to adjust a temperature of the shot tube plunger.

20 Claims, 5 Drawing Sheets

SHOT TUBE PLUNGER FOR A DIE CASTING SYSTEM

BACKGROUND

This disclosure relates generally to die casting systems, and more particularly to a shot tube plunger for a die casting system that includes a thermal control scheme for maintaining a temperature of the shot tube plunger.

Casting is a known technique used to yield near net-shaped components. For example, investment casting is often used in the gas turbine engine industry to manufacture near net-shaped components, such as blades and vanes having relatively complex geometries. A component is investment cast by pouring molten metal into a ceramic shell having a cavity in the shape of the component to be cast. Generally, the shape of the component to be produced is derived from a wax pattern or SLA pattern that defines the shape of the component. The investment casting process is capital intensive, requires significant manual labor and can be time intensive to produce the final component.

Die casting offers another known casting technique. Die casting involves injecting molten metal directly into a reusable die to yield a near net-shaped component. The components of the die casting system, including the shot tube and the shot tube plunger, are subjected to relatively high thermal loads and stresses during the die casting process.

SUMMARY

A shot tube plunger of a die casting system includes a tip portion and a thermal control scheme at least partially disposed within the shot tube plunger. The thermal control scheme includes a fluid passageway having at least one coiled portion that receives a fluid to adjust a temperature of the shot tube plunger.

In another exemplary embodiment, a die casting system includes a die, a shot tube and a shot tube plunger. The die includes a plurality of die elements that define a die cavity. The shot tube is in fluid communication with the die cavity. The shot tube plunger is moveable within the shot tube to communicate a charge material into the die cavity. The shot tube plunger includes a tip portion having a plurality of tip layers that are coaxially disposed relative to one another to define a portion of a fluid passageway of the thermal control scheme.

In yet another exemplary embodiment, a method for controlling a temperature of a portion of a die casting system includes communicating a fluid through a fluid inlet of a fluid passageway of a thermal control scheme of a shot tube plunger. The fluid is circulated through the fluid passageway of the thermal control scheme to either heat or cool the fluid passageway. The fluid is then discharged through a fluid outlet of the fluid passageway of the thermal control scheme.

The various features and advantages of this disclosure will become apparent to those skilled in the art from the following detailed description. The drawings that accompany the detailed description can be briefly described as follows.

DETAILED DESCRIPTION

Figure 1:
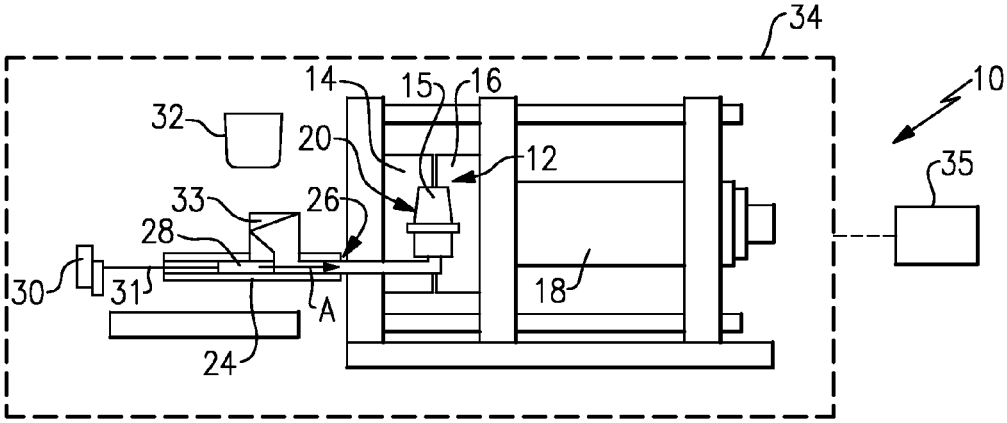
FIG. 1 illustrates an example die casting system.

FIG. 1 illustrates a die casting system 10 including a reusable die 12 having a plurality of die elements 14, 16 that function to cast a component 15. The component 15 could include aeronautical components, such as gas turbine engine blades or vanes, or non-aeronautical components. Although two die elements 14, 16 are depicted by FIG. 1, it should be understood that the die 12 could include more or fewer die elements, as well as other parts and other configurations.

The die 12 is assembled by positioning the die elements 14, 16 together and holding the die elements 14, 16 at a desired position via a mechanism 18. The mechanism 18 could include a clamping mechanism powered by a hydraulic system, pneumatic system, electromechanical system and/or other systems. The mechanism 18 also separates the die elements 14, 16 subsequent to casting.

The die elements 14, 16 include internal surfaces that cooperate to define a die cavity 20. A shot tube 24 is in fluid communication with the die cavity 20 via one or more ports 26 that extend into the die element 14, the die element 16 or both. A shut tube plunger 28 is received within the shot tube 24 and is moveable between a retracted and injected position (in the direction of arrow A) within the shot tube 24 by a mechanism 30. A shot rod 31 extends between the mechanism 30 and the shot tube plunger 28. The mechanism 30 could include a hydraulic assembly or other suitable system, including, but not limited to, pneumatic, electromechanical, hydraulic or any combination of the systems.

The shot tube 24 is positioned to receive a charge of material from a melting unit 32, such as a crucible, for example. The melting unit 32 may utilize any known technique for melting an ingot of metallic material to prepare molten metal for delivery to the shot tube 24. In this example, the charge of material is melted into molten metal by the melting unit 32 at a location that is separate from the shot tube 24 and the die 12. However, other melting configurations are contemplated as within the scope of this disclosure. The example melting unit 32 is positioned in relative close proximity to the die casting system 10 to reduce the transfer distance of the charge of material between the melting unit 32 and the die casting system 10.

Materials used to die cast a component 15 with the die casting system 10 include, but are not limited to, nickel-based super alloys, cobalt-based super alloys, titanium alloys, high temperature aluminum alloys, copper-based alloys, iron alloys, molybdenum, tungsten, niobium or other refractory metals. This disclosure is not limited to the disclosed alloys, and other high melting temperature materials may be utilized to die cast a component 15. As used in this disclosure, the term "high melting temperature material" is intended to include materials having a melting temperature of approximately 1500° F./815° C. and higher.

The charge of material is transferred from the melting unit 32 to the die casting system 10. For example, the charge of material may be poured into a pour hole 33 of the shot tube 24. A sufficient amount of molten metal is communicated to the shot tube 24 to fill the die cavity 20. The shot tube plunger 28 is actuated to inject the charge of material under pressure from the shot tube 24 into the die cavity 20 to cast a component 15. Although the casting of a single component 15 is depicted, the die casting system 10 could be configured to cast multiple components in a single shot.

Although not necessary, at least a portion of the die casting system 10 can be positioned within a vacuum chamber 34 that includes a vacuum source 35. A vacuum is applied in the vacuum chamber 34 via the vacuum source 35 to render a vacuum die casting process. The vacuum chamber 34 provides a non-reactive environment for the die casting system 10. The vacuum chamber 34 therefore reduces reaction, contamination or other conditions that could detrimentally affect the quality of the die cast component, such as excess porosity of the die cast component from exposure to air. In one example, the vacuum chamber 34 is maintained at a pressure between $5\times10^{-3}$ Torr (0.666 Pascal) and $1\times10^{-6}$ Torr (0.000133 Pascal), although other pressures are contemplated. The actual pressure of the vacuum chamber 34 will vary based on the type of component 15 or alloy being cast, among other conditions and factors. In the illustrated example, each of the melting unit 32, the shot tube 24 and the die 12 are positioned within the vacuum chamber 34 during the die casting process such that the melting, injecting and solidifying of the high melting temperature material are all performed under vacuum. In another example, the vacuum chamber 34 is backfilled with an inert gas, such as argon, for example.

The example die casting system 10 of FIG. 1 is illustrative only and could include more or fewer sections, parts and/or components. This disclosure extends to all forms of die casting, including but not limited to, horizontal, inclined or vertical die casting systems and other die casting configurations.

Figure 2A:
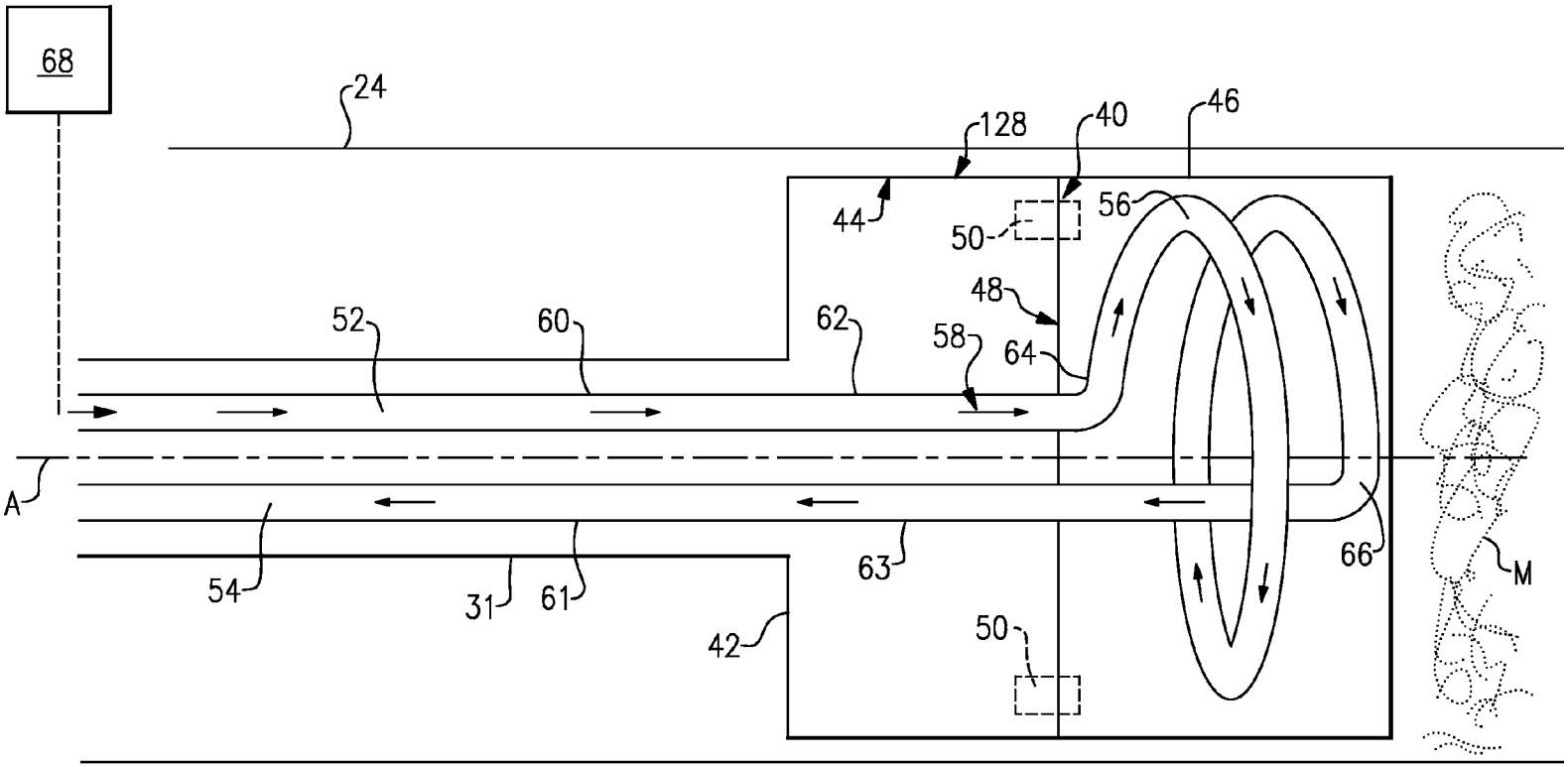
FIG. 2A illustrates an example shot tube plunger for use with a die casting system.

FIG. 2A illustrates an example shot tube plunger 128 for use with a die casting system, such as the die casting system 10. In this disclosure, like reference numerals signify like features, and reference numerals identified in multiples of 100 signify slightly modified features. Moreover, selected features of one example embodiment may be combined with selected features of other example embodiments within the scope of this disclosure. In addition, it should be understood that the shot tube plunger 128 is not shown to the scale it would be in practice. Rather, the shot tube plunger 128 is shown enlarged to better illustrate its features.

The shot tube plunger 128 includes a first face 40, a second face 42 and a plunger body 44 that extends between the first face 40 and the second face 42. The first face 40 faces toward a charge of material M within the shot tube 24, while the second face 42 faces toward and receives a portion of the shot rod 31. In this example, the plunger body 44 of the shot tube plunger 128 includes a cylindrical shape disposed about a longitudinal axis A of the shot tube plunger 128, although other shapes are contemplated as within the scope of this disclosure. The example shot tube plunger 128 could be made from copper, copper alloys or other suitable materials.

The shot tube plunger 128 also includes a tip portion 46 and a thermal control scheme 48 for controlling a temperature of the shot tube plunger 128 during the die casting of a component made from a high melting temperature material. In particular, the thermal control scheme 48 controls the temperature of the tip portion 46 of the shot tube plunger 128, which is the portion of the shot tube plunger 128 that is in direct contact with molten metal M during the die casting process. The tip portion 46 is attached to the first face 40 of the shot tube plunger 128 such that the tip portion 46 is positioned axially forward (in this case, toward the charge of material M) of the first face 40. In this example, the tip portion 46 is attached to the first face 40 of the shot tube plunger 128 with fasteners 50. Other attachment methods are contemplated as within the scope of this disclosure.

The thermal control scheme 48 includes a fluid inlet 52, a fluid outlet 54 and a coiled portion 56. The fluid inlet 52, the fluid outlet 54 and the coiled portion 56 define a fluid passageway 58 (shown schematically with arrows) of the thermal control scheme 48. The fluid passageway 58 receives a fluid, such as water, that is circulated through the thermal control scheme 48 to either add or remove heat from the shot tube plunger 128, and in particular, from the tip portion 46. In other words, the thermal control scheme 48 can either heat or cool the fluid passageway 58 and in turn adjust a temperature of the shot tube plunger 128.

The fluid passageway 58 of the thermal control scheme 48 is disposed internally to the shot rod 31 and the shot tube plunger 128. The thermal control scheme 48 can be cast or machined into the shot rod 31 and the shot tube plunger 128. For example, portions 60, 61 of the fluid inlet 52 and the fluid outlet 54, respectively, are disposed inside the shot rod 31. The shot tube plunger 128 also receives portions 62, 63 of the fluid inlet 52 and the fluid outlet 54, respectively. The coiled portion 56 is disposed within the tip portion 46 of the shot tube plunger 128, and is connected at an inlet 64 of the coiled portion 56 to receive fluid from the fluid inlet 52. The fluid is circulated through the coiled portion 56 and exits through an outlet 66 of the coiled portion 56. The fluid is then communicated through the fluid outlet 54 and exits the shot rod 31 for disposal or recirculation. A fluid source 68 provides a fluid, such as water, for circulation through the fluid passageway 58 of the thermal control scheme 48 to heat or cool the tip portion 46 of the shot tube plunger 128.

Alternatively, the thermal control scheme 48 can include multiple tubing sections that are separate from and positioned within the internal passageways formed in the shot rod 31 and the shot tube plunger 128. In this way, the thermal control scheme would provide a "closed-loop fluid passageway" in which the fluid that is circulated through the thermal control scheme 48 does not come into contact with the external surfaces of the shot rod 31 and shot tube plunger 128.

Figure 2B:
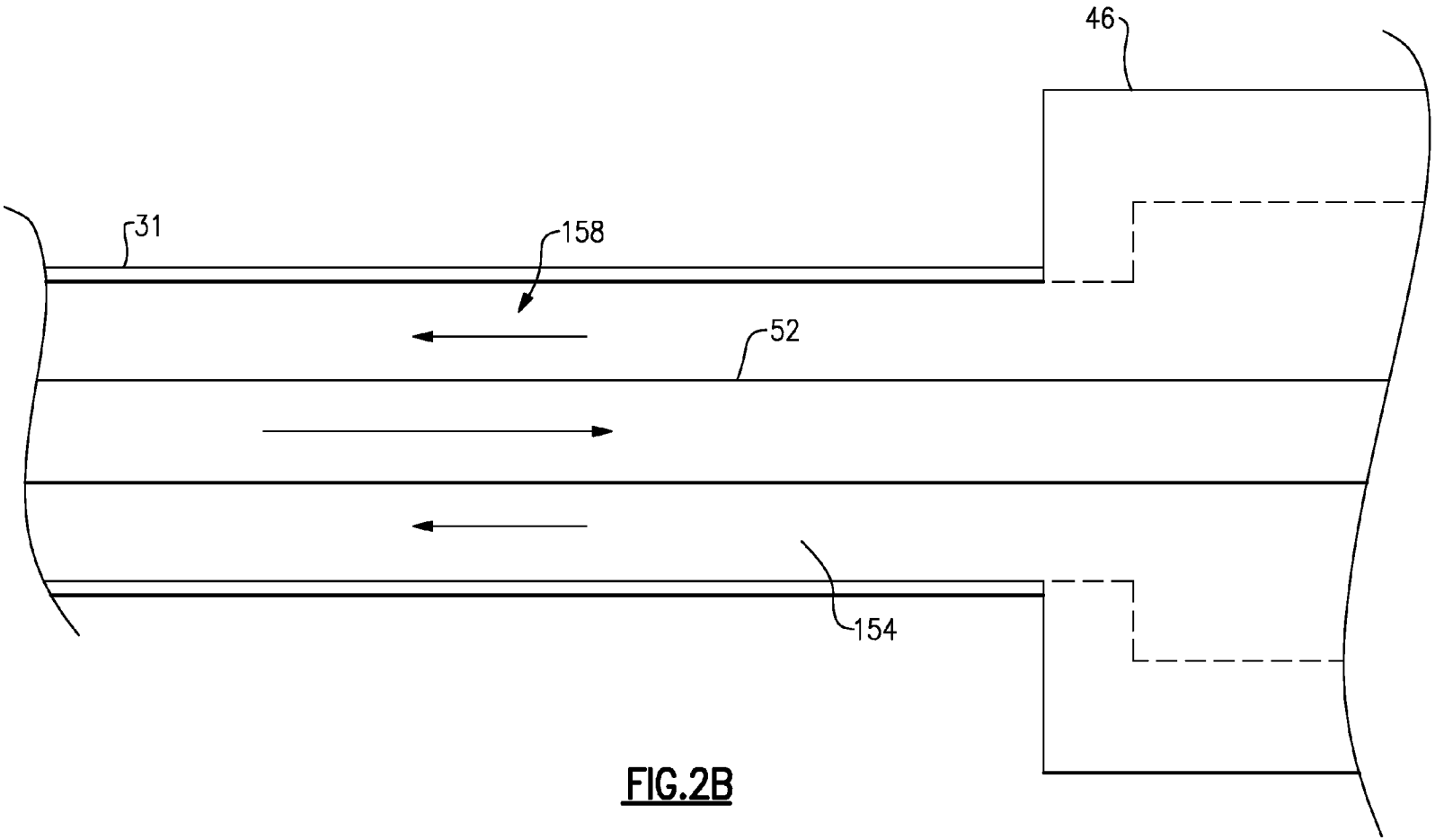
FIG. 2B illustrates a portion of an example shot tube plunger.

FIG. 2B illustrates a slightly modified fluid passageway 158. In this example, a fluid outlet 154 surrounds the fluid inlet 52. In other words, the fluid inlet 52 extends through the fluid outlet 154 to communicate the fluid into and out of the fluid passageway 158.

Figure 3:
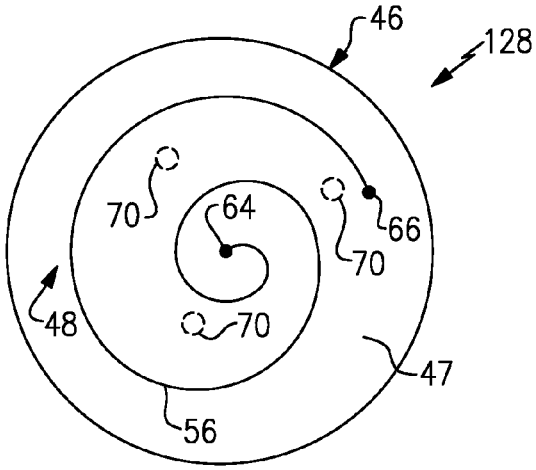
FIG. 3 illustrates a tip portion of an example shot tube plunger.

FIG. 3 illustrates an end view of the tip portion 46 of the shot tube plunger 128. In this example, the coiled portion 56 is helix-shaped. Other shapes are contemplated, including spiral shaped portions or other non-linear portions.

The thermal control scheme 48 could further include one or more thermocouples 70 embedded within a surface 47 of the tip portion 46. The thermocouples 70 may be embedded at any location of the tip portion 46. In this example, the thermocouple 70 is embedded at a location directly adjacent to the coiled portion 56 of the thermal control scheme 48. The embedded thermocouple 70 monitors a temperature of the tip portion 46 and indicates whether the temperature of the fluid circulated through the thermal control scheme 48 should be increased or decreased to either heat or cool the shot tube plunger 128 as desired.

The thermocouples 70 could include type K, type J or type T thermocouples. Other thermocouples are also contemplated as within the scope of this disclosure and could be chosen depending upon design specific parameters, including but not limited to, atmospheric temperatures and the alloy used to cast a component.

Figure 4A:
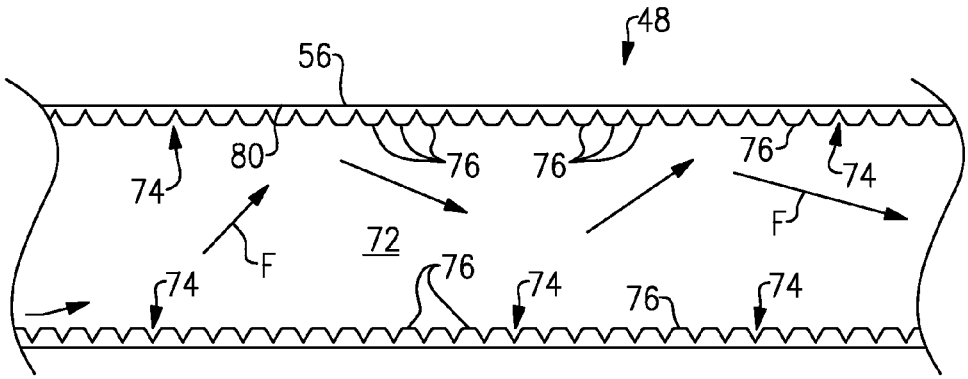
FIGS. 4A-4D illustrate features of an example shot tube plunger.

FIGS. 4A-4D depict other example features of the thermal control scheme 48. For example, the coiled portions 56 of the fluid passageway 58 can include internal passageways 72 having geometric features 74 designed to create a turbulent fluid flow F within the internal passageway 72 and increase the amount of heat transfer that occurs between the fluid and the shot tube plunger 128. As shown in FIG. 4A, for example, the geometric features 74 include knurled textures 76 that protrude from a wall 80 of the internal passageway.

Figure 4B:
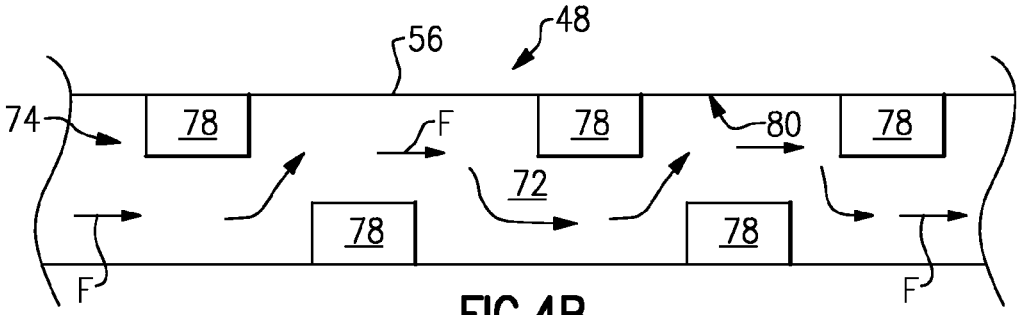
Figure 4C:
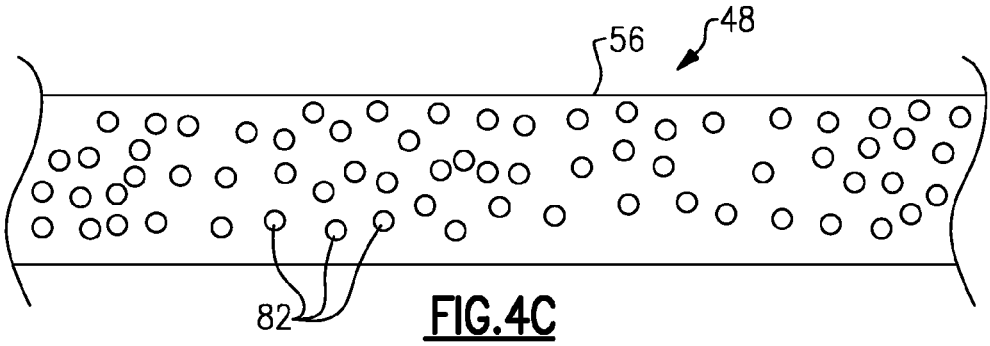
Figure 4D:
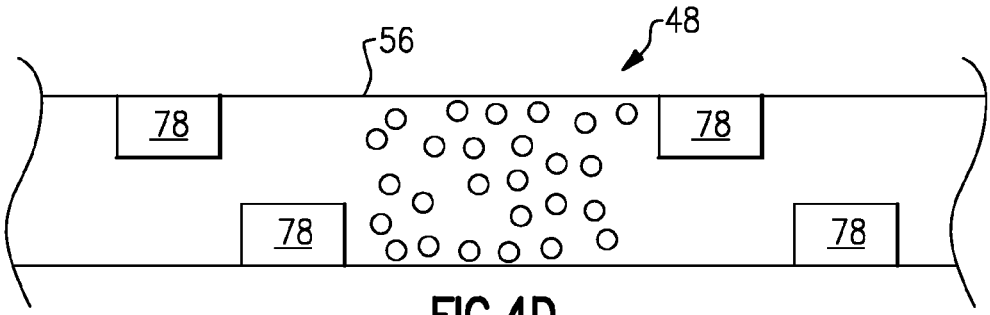

Alternatively, as shown in FIG. 4B, the geometric features 74 include alternating trip strips 78 that protrude from the wall 80 of the internal passageway 72. FIG. 4C illustrates that the geometric features 74 could include pedestals 82. In addition, as depicted in FIG. 4D, the geometric feature 74 of the internal passageway 72 could include a combination of features, such as pedestals 82 in combination with trip strips 78. Other geometric features and combinations of features for increasing heat transfer are contemplated as within the scope of this disclosure.

Figure 5:
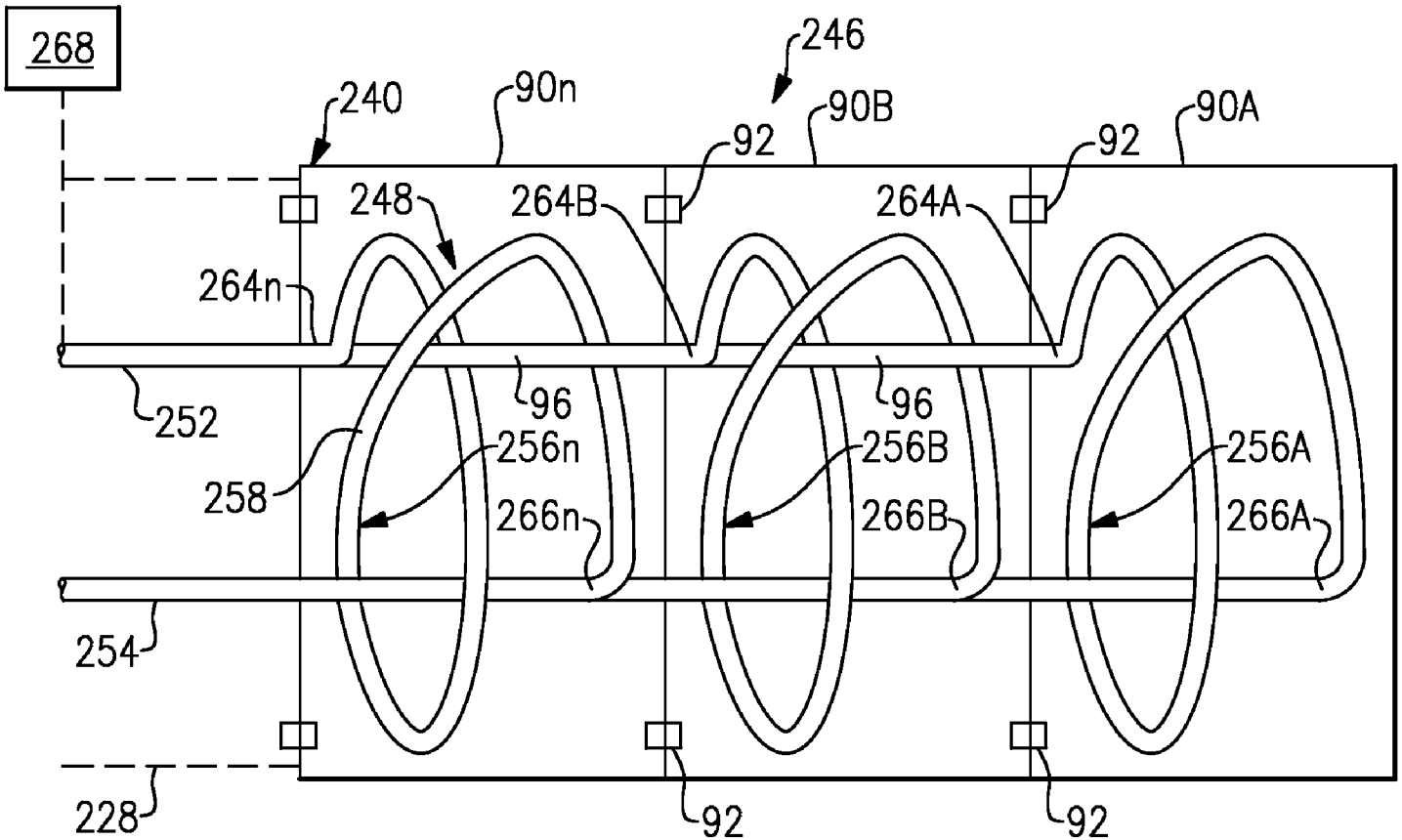
FIG. 5 illustrates another example shot tube plunger for use with a die casting system.

FIG. 5 illustrates another example shot tube plunger 228 for use with a die casting system. The shot tube plunger 228 is similar to the shot tube plunger 128 described above, except that the shot tube plunger 228 includes a modified tip portion 246. FIG. 5 is not to scale, but is shown enlarged to better detail the features of the tip portion 246.

In this example, the tip portion 246 includes a plurality of tip layers 90A-90*n* that are axially stacked upon one another (from the left to the right of FIG. 5) to provide a tip portion 246 having a desired thermal control scheme 248. In other words, the tip layers 90A-90*n* are coaxially disposed relative to the shot tube plunger 128. The actual number of tip layers 90 used will vary depending upon the cooling requirements of the shot tube plunger 128, among other factors. The stacked tip layers 90A-90*n* are attached relative to one another in a known manner, such as with a fastener 92. The tip portion 246 may then be attached to a first face 240 of the shot tube plunger 228.

The thermal control scheme 248 defines a fluid passageway 258. In one example, each tip layer 90A-90*n* includes a coiled portion 256A-256*n* of the fluid passageway 258. In this manner, a multiple layered thermal control scheme 248 is provided within the tip portion 246.

Each coiled portion 256A-256*n* includes an inlet 264A-264*n* and an outlet 266A-266*n* for receiving and discharging a fluid, respectively. The inlets 264A-264*n* of the coiled portions 256A-256*n* are connected to the inlet(s) of adjacent coiled portions via passages 96 such that fluid from a fluid source 268 is communicated through a fluid inlet 252 and is circulated through each coiled portion 256A-256*n* of the thermal control scheme 248. In other words, the inlet 264A of the coiled portion 256A is connected to the inlet 264B of the coiled portion 256B and so on. The outlets 266A-266*n* are in fluid communication with a fluid outlet 254 to discharge the circulated fluid.

Although not shown, the shot tube plunger 228 can also include other features such as those shown in FIG. 3 and FIG. 4. For example, the shot tube plunger 228 could include an embedded thermocouple or geometric features disposed within the internal passageways of the coiled portions 256.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A die casting system, comprising:

a shot tube plunger including a plunger body and a tip portion attached only at a first face of said plunger body, wherein said tip portion is a separate structure from said plunger body; and a thermal control scheme at least partially disposed inside of said shot tube plunger, wherein said thermal control scheme includes a fluid passageway having at least one coiled portion that extends at least partially through said tip portion and receives a fluid to adjust a temperature of said shot tube plunger.

2. The system as recited in claim 1, wherein said thermal control scheme includes a fluid inlet, a fluid outlet and said at least one coiled portion.

3. The system as recited in claim 1, wherein said thermal control scheme includes a plurality of coiled portions.

4. The system as recited in claim 1, wherein said at least one coiled portion is entirely disposed within said tip portion.

5. The system as recited in claim 1, comprising a thermocouple embedded in a surface of said tip portion.

6. The system as recited in claim 1, wherein an internal passageway of said at least one coiled portion includes a geometric feature that protrudes from a wall of said internal passageway.

7. The system as recited in claim 6, wherein said geometric feature includes one of a knurled texture and alternating trip strips.

8. A die casting system, comprising:

a die including a plurality of die elements that define a die cavity;

a shot tube in fluid communication with said die cavity; and a shot tube plunger moveable within said shot tube to communicate a charge of material into said die cavity, wherein said shot tube plunger includes a tip portion that is a separate structure from said shot tube plunger and a thermal control scheme, wherein said tip portion includes a plurality of tip layers that are coaxially disposed to define a portion of a fluid passageway of said thermal control scheme, and said tip portion is attached only at a first face of said shot tube plunger that faces toward said charge of material within said shot tube.

9. The system as recited in claim 8, wherein each of said plurality of tip layers include a coiled portion of said fluid passageway.

10. The system as recited in claim 9, wherein said coiled portions are helix-shaped.

11. The system as recited in claim 9, comprising a passage that connects an inlet of each of said coiled portions.

12. The system as recited in claim 8, comprising a shot rod connected to said shot tube plunger on an opposite side from said tip portion, wherein a portion of said fluid passageway is disposed within said shot rod.

13. The system as recited in claim 1, wherein said fluid passageway includes a fluid inlet and a fluid outlet that surrounds said fluid inlet.

14. The system as recited in claim 1, wherein said tip portion is attached to said shot tube plunger.

15. The system as recited in claim 1, wherein said tip portion includes a plurality of tip layers that are axially stacked relative to one another.

16. The system as recited in claim 8, wherein said tip portion is attached to said shot tube plunger.

17. The system as recited in claim 8, wherein at least a portion of said die casting system is positioned within a vacuum chamber.

18. The system as recited in claim 8, wherein said plurality of tip layers are attached to one another to establish said tip portion and said tip portion is attached to said shot tube plunger.

19. The system as recited in claim 8, wherein said fluid passageway includes a plurality of coiled portions, and an inlet of a first coiled portion of said plurality of coiled portions is connected to an inlet of a second coiled portion of said plurality of coiled portions.

20. A die casting system, comprising:

a shot tube plunger;

a tip portion attached to a first face of said shot tube plunger;

a shot rod attached to a second face of said shot tube plunger; and a thermal control scheme disposed internal to said shot tube plunger and said shot rod, wherein said thermal control scheme includes a fluid inlet; and a fluid outlet that extend in parallel in a direction of a longitudinal axis of said shot tube plunger and multiple coiled portions each having an inlet and an outlet, and wherein each of said inlets of said multiple coiled portions are connected to said fluid inlet and each of said outlets of said multiple coiled portions are connected to said fluid outlet.

* * * * *